US008550652B2

(12) United States Patent
Tseng

(10) Patent No.: US 8,550,652 B2
(45) Date of Patent: Oct. 8, 2013

(54) LIGHT-EMITTING DECORATION

(76) Inventor: Shen-Ko Tseng, Taipei (TW)

( * ) Notice: Subject to any disclaimer, the term of this patent is extended or adjusted under 35 U.S.C. 154(b) by 270 days.

(21) Appl. No.: 13/114,764

(22) Filed: May 24, 2011

(65) Prior Publication Data

US 2011/0292642 A1 Dec. 1, 2011

(30) Foreign Application Priority Data

May 25, 2010 (CN) ..... 2010 2 0201276 U

(51) Int. Cl.
*F21V 31/03* (2006.01)
*F21L 4/00* (2006.01)

(52) U.S. Cl.
USPC ..... 362/158; 362/104; 362/311.02

(58) Field of Classification Search
USPC ..... 362/103, 104, 128, 122, 158, 311.02, 362/311.04
See application file for complete search history.

(56) References Cited

U.S. PATENT DOCUMENTS 3,067,322 A * 12/1962 Sala ..... 362/103
3,383,503 A * 5/1968 Montgomery ..... 362/104
5,083,250 A * 1/1992 Malcolm ..... 362/253
6,626,184 B1 * 9/2003 Cheng ..... 132/275

* cited by examiner

*Primary Examiner* — David V Bruce

(57) ABSTRACT

The invention discloses a light-emitting decoration which includes a main portion and an engagement portion. The engagement element is disposed on one side of the main portion. The engagement portion comprises an extending portion to form a first accommodating space. The engagement portion comprises a gap to connect through the first accommodating space. Accordingly, while the light-emitting decoration is engaged with the subject object, the gap expends elastically for letting the subject object enter the first accommodating space through the gap.

12 Claims, 3 Drawing Sheets

LIGHT-EMITTING DECORATION

BACKGROUND OF THE INVENTION

1. Field of the Invention

The present invention relates to a light-emitting decoration. More particularly, the invention is related to a light-emitting decoration which can be engaged with ropes or strips.

2. Description of the Prior Art

To achieve the effects of beauty, interest or features addition, many decorations are used to beautify the shoes, hats or cloths. The decorations can be fixed on the cloths by sewing or sticking in order to prevent from dropping in an activity or a washing process. However, the user cannot change the style by changing the decorations due to the way of fixing, so that the interest will be decreased.

Currently, some decorations can be movable engagement portions, such as pins or buttons, for letting the user change the decorations by themselves. However, these ways of fixing is suitable for objects which have large area, such as cloths, hats or shoes. The decorations cannot be fixed on the objects like shoelace.

SUMMARY OF THE INVENTION

Accordingly, a scope of the invention is to provide a light-emitting decoration, which can be movably engaged with the ropes or strips for solving the problems of the prior art.

According to one embodiment of the invention, the light-emitting decoration comprises a main portion and an engagement portion. The engagement portion, disposed on one side of the main portion, comprises an extending portion to form a first accommodating space. The engagement portion has a gap to connect with the first accommodating space through the gap. Accordingly, while the light-emitting decoration is engaged with a subject object, the gap expends elastically for letting the subject object enter the first accommodating space through the gap.

In practice, the engagement portion has a holding portion at the end of the extending portion. The extending portion and holding portion generally are shaped like C. Additionally, the gap is formed between the two holding portions or between the holding portion and the main portion. Furthermore, the extending portions are close to each other and overlapped at the two sides of the gap.

The main portion further comprises a second accommodating space and an open part, wherein the main portion and the engagement portion are integrally formed. Additionally, the light-emitting decoration further comprises a shaping element, which is fixed on a surface of the main portion. In practice, the shaping element covers and seals an open part of the main portion and the main portion and the engagement portion can also be integrally formed.

In practice, the invention further comprises a light-emitting module. The light-emitting module is placed in the second accommodating space through the open part. The light-emitting module can further comprise an actuator switch and a water-proof shell. The actuator switch can sense the movement of the light-emitting module for generating a control signal. A controller, electrically connected to the actuator switch, receives the control signal and controls a light-emitting diode to emit light according to the control signal.

Additionally, the water-proof shell can be used to sealing a light-emitting element, the controller, a power source and the actuator switch. The water-proof shell is formed by resin or plastic through an injection molding process. In practice, the shape of the shaping element can be animals, plants, landscape, portrait or geometry.

To sum up, the light-emitting decoration can be movably engaged with the ropes or strips for solving the problems of the prior art.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
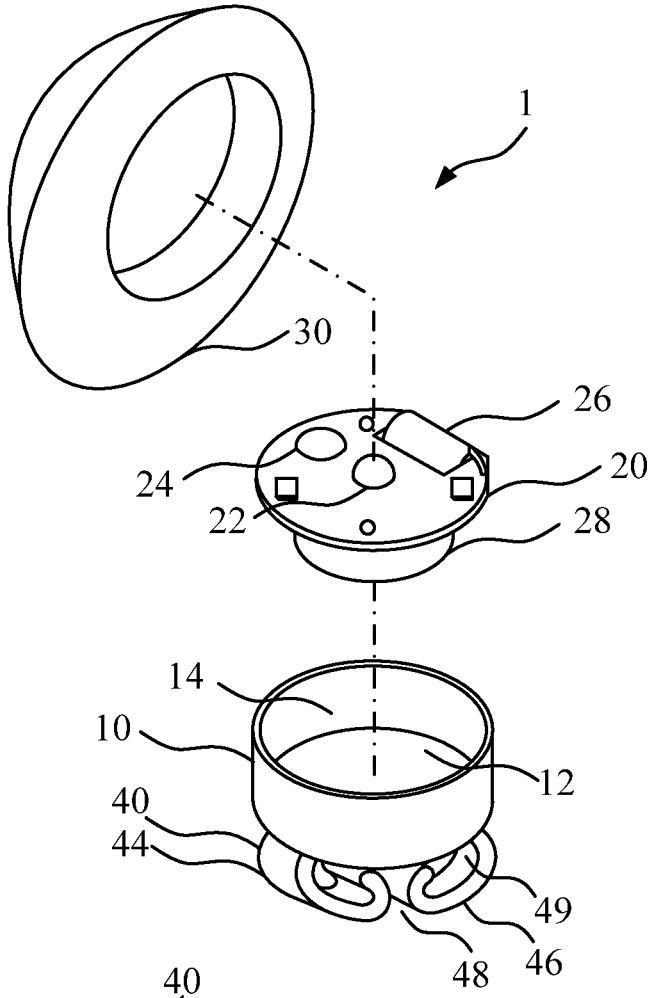
FIG. 1 illustrates a diagram of the light-emitting decoration according to one embodiment of the invention.

Please refer to FIG. 1. FIG. 1 illustrates a diagram of the light-emitting decoration according to one embodiment of the invention. As shown in FIG. 1, the light-emitting decoration of the invention comprises a main portion 10, a light-emitting module 20, a shaping element 30, and an engagement portion 40.

The main portion 10 comprises a second accommodating space 12, open part 14, and an upper surface 16.

The light-emitting module 20 is placed in the second accommodating space 12 through the open part 14. The light-emitting module 20 comprises a light-emitting element 22, a controller 24, an actuator switch 26, and a power source 28. In practice, the light-emitting element 22 comprises a package (not shown in figures), wire set (not shown in figures), and a light-emitting diode (not shown in figures). To be noticed, the implement of the package, the wire set, and the light-emitting diode are known by a person who has common knowledge in the field of the invention, and it will no longer be explained.

The controller 24 of the light-emitting module 20 is electrically connected to the wire set of the light-emitting element 22, for controlling the light-emitting diode to emit light. The actuator switch 26 is electrically connected to the controller 24, which can sense the movement of the light-emitting module 20 for generating a control signal. The controller 24 can receive the control signal and control a light-emitting diode to emit light according to the control signal.

The power source 28 is electrically connected to the light-emitting element 22, the controller 24, and the actuator switch 26, for providing the electrical power for the elements of the light-emitting module 20.

In one embodiment, the shaping element 30 is fixed on a surface of the main portion 10 to cover and seal the open part 14. However, the shaping element 30 is not limited to cover or seal the open part 14. According to the design, the shaping element 30 can be disposed on a first surface of the main portion 10, used to cover the engagement portion 40 and seal the open part 14. The detail can be changed in small-scale, and it will no longer be explained. Furthermore, the exterior of the shaping element 30 can be a cone generally. In practice, the exterior of the shaping element 30 can be designed as it needs, such as animals, plants, landscape, portrait or geometry.

The engagement portion 40 comprises a base 42, a extending portion 44, a holding portion 46, and a gap 48. In the embodiment, the engagement portion 40 and the main portion 10 can be, but not limited to integrally form. In addition, the engagement portion 40 and the main portion 10 can be manufactured separately and fixed to each other. The base 42 of the engagement portion 40 is connected to the upper surface 16 of the main portion 10. The extending portion 44 extends outward from the base 42 and surrounds to form a first accommodating space 49 for accommodating the subject object (not shown in figures). The holding portion 46 is disposed at the end of the extending portion 44 for preventing the subject object from dropping from the first accommodating space.

The engagement portion 40 connected to the first accommodating space 49 through the gap.48. While the light-emitting decoration 1 is engaged with a subject object (not shown in figures), the gap 48 expends elastically for letting the subject object enter the first accommodating space 49 through the gap 48. In practice, the subject object can be any suitable objects, such as shoelace, ropes or strips.

Figure 2:
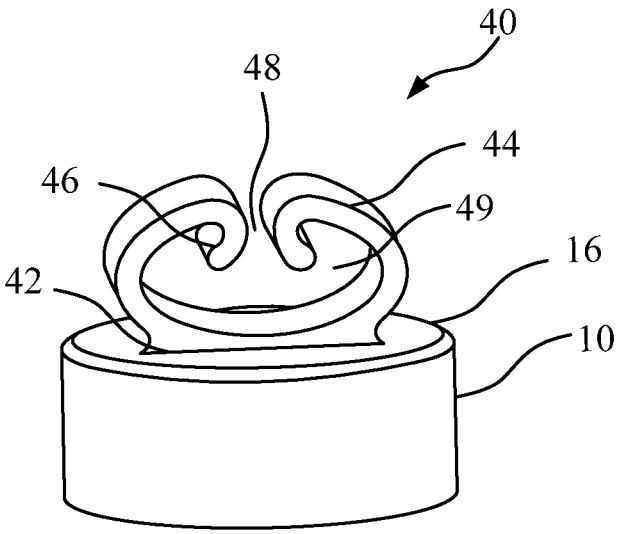
FIG. 2 illustrates a diagram of the engagement portion according to one embodiment of the invention.

Please refer to FIG. 2. FIG. 2 illustrates a diagram of the engagement portion according to one embodiment of the invention. In the embodiment, the holding portion 46 of the engagement portion 40 extends opposite to the extension direction of the end of the extending portion 44 and concaves like a hook. As shown in figures, the extending portion 44 of the engagement portion 40 and holding portion 46 generally are shaped like C, so that the subject object can be rigidly fixed in the accommodating space 49. Furthermore, the base 42 comprises the plurality of extending portions 44, each extending portions 44 comprises a holding portion 46. Each extending portion 44 extends outward and surrounds to form a first accommodating space 49. The shape of two extending portions 44 and related two holding portions 46 are the same. The gap 48 is formed between two holding portion 46.

The gap 48 is connected to the first accommodating space 49. While the light-emitting decoration 1 is engaged with a subject object (not shown in figures), the gap 48 expends elastically for letting the subject object enter the first accommodating space 49 through the gap. In practice, the subject object can be any suitable objects, such as shoelace, ropes or strips. Other primarily features of the embodiment are disclosed in the previous embodiment and it will no longer be explained.

Figure 3:
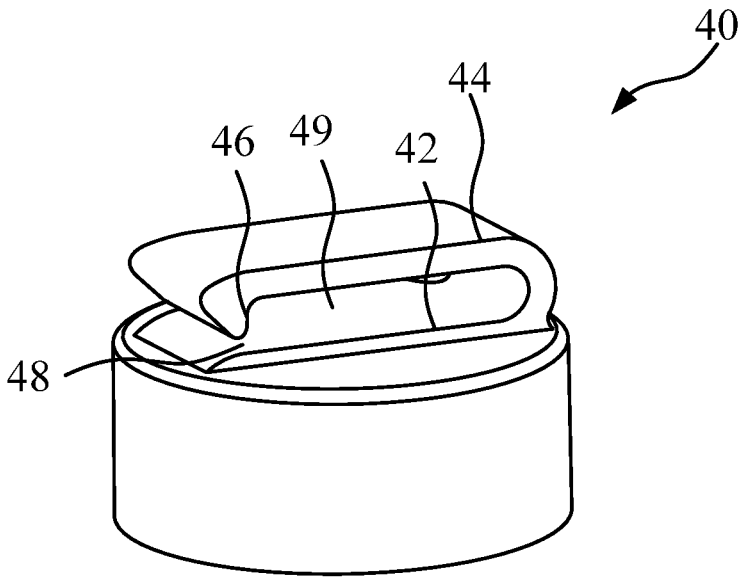
FIG. 3 illustrates a diagram of the engagement portion according to another embodiment of the invention.

Please refer to FIG. 3. FIG. 3 illustrates a diagram of the engagement portion according to another embodiment of the invention. In the embodiment, the holding portion 46 is a pyramidal protrusion which is formed at the end of the extending portion 44 for preventing the subject object from dropping from the first accommodating space 49. Furthermore, the base 42 comprises an extending portion 44 and a holding portion 46 is formed at the end of the extending portion 44. The extending portion 44 extends outward and surrounds to form the first accommodating space 49. The gap 48 is formed between the holding portion 46 and the base 42. Other primarily features of the embodiment are disclosed in the previous embodiment and it will no longer be explained.

Figure 4:
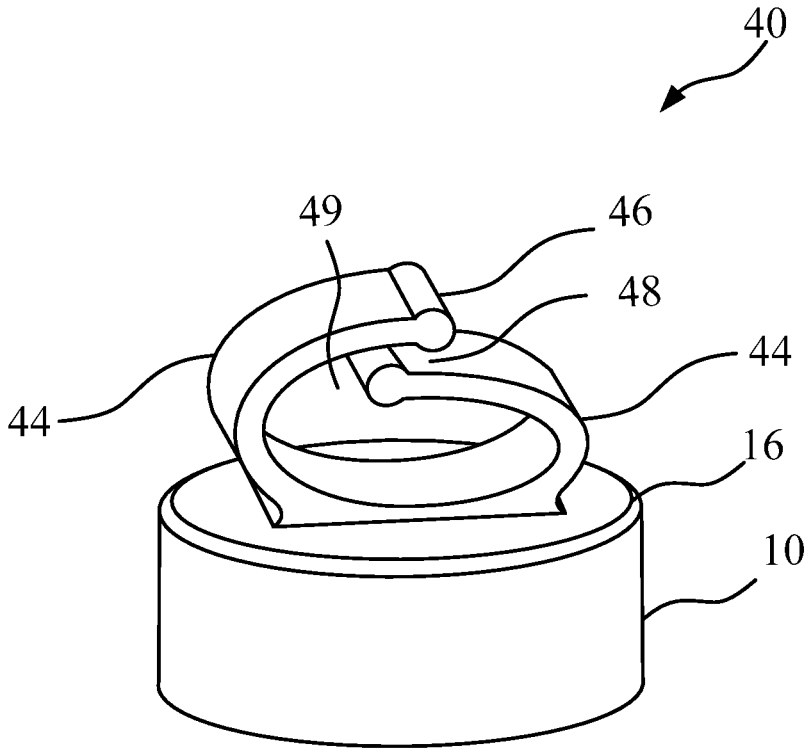
FIG. 4 illustrates a diagram of the engagement portion according to another embodiment of the invention.

Please refer to FIG. 4. FIG. 4 illustrates a diagram of the engagement portion according to another embodiment of the invention. In the embodiment, the holding portion 46 is a cylinder protrusion which is formed at the end of the extending portion 44, for preventing the subject object from dropping from the first accommodating space 49. In the embodiment, the base 42 comprises a plurality of the extending portion 44. Each extending portion 46 comprises a holding portion 46. In the embodiment, one holding portion 46 is higher than another one and overlapped horizontally. The gap 48 is formed between each two holding portions 46 and the extending portions 46 are overlapped at the two sides of the gap 48. Accordingly, the subject object fixed in the first accommodating space 49 is hard to drop from the first accommodating space 49. Other primarily features of the embodiment are disclosed in the previous embodiment and it will no longer be explained.

Figure 5:
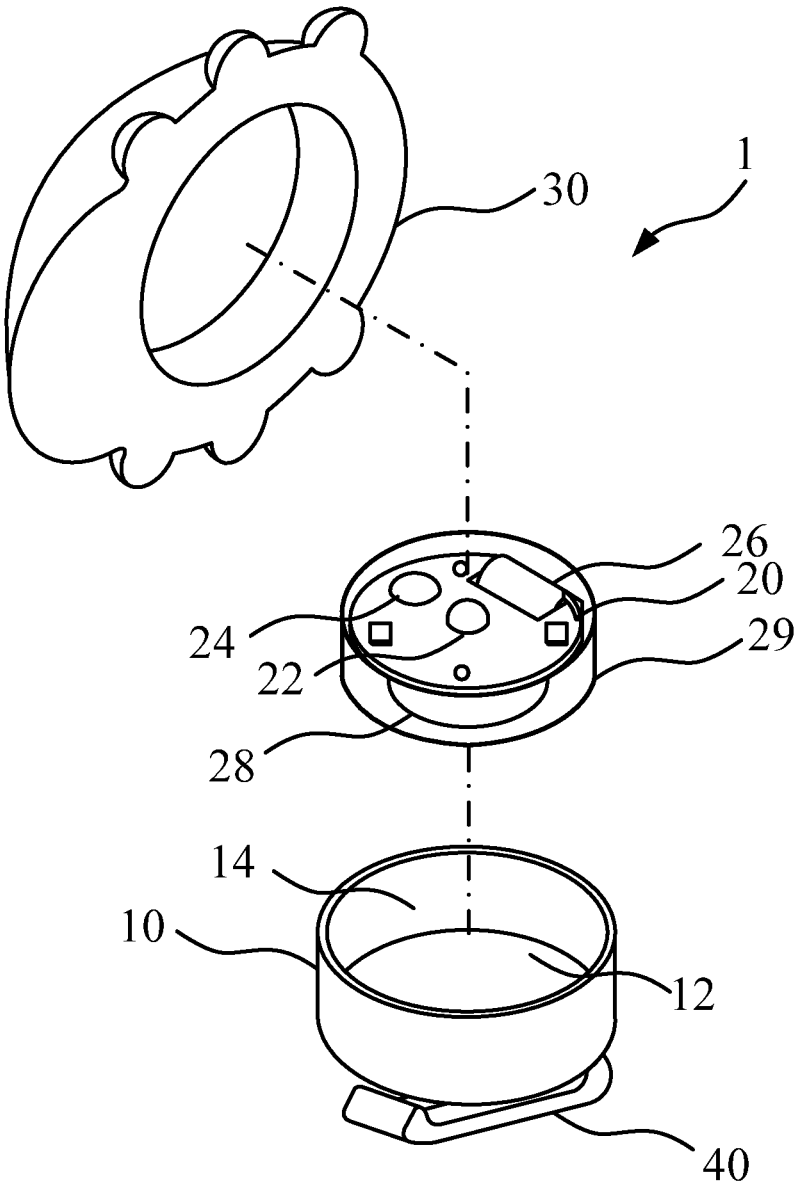
FIG. 5 illustrates a diagram of the light-emitting decoration according to another embodiment of the invention.

Please refer to FIG. 5. FIG. 5 illustrates a diagram of the light-emitting decoration according to another embodiment of the invention. As shown in FIG. 5, the main features of the light-emitting decoration 1 are similar to previous embodiments. In this embodiment, the difference is that the shaping element 30 has an insect appearance. In practice, the appearance of the shaping element 30 can be manufactured in accordance with the situation, such as animals, plants, landscape, portrait or geometry.

Furthermore, the light-emitting module 20 further comprises a water-proof shell 29. The light-emitting element 22, the controller 24, the actuator switch 26 and the power source 28 can be sealed by the water-proof shell 29. In practice, the water-proof shell 29 is formed by resin or plastic through an injection molding process.

To sum up, compared to the prior art, the light-emitting decoration can be movably engaged with the ropes or strips for solving the problem of the prior art.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A light-emitting decoration, comprising:

a main portion; and an engagement portion, disposed on one side of the main portion, comprising a plurality of extending portions overlapped mutually so as to form a first accommodating space, the engagement portion having a gap, disposed between the plurality of extending portions;

wherein, while the light-emitting decoration is engaged with a subject object, the gap capably expends for allowing the subject object to enter the first accommodating space therethrough.

2. The light-emitting decoration of claim 1, wherein the engagement portion has a holding portion disposed at the end of the extending portion.

3. The light-emitting decoration of claim 1, wherein the main portion further comprises:

a second accommodating space and an open part.

4. The light-emitting decoration of claim 3, further comprising a light-emitting module, the light-emitting module is placed in the second accommodating space via the open part.

5. The light-emitting decoration of claim 4, wherein the light-emitting module further comprises:

an actuator switch, sensing the movement of the light-emitting module for generating a control signal, and a controller electrically connected to the actuator switch for receiving the control signal and controlling a light-emitting diode to emit light according to the control signal.

6. The light-emitting decoration of claim 5, wherein the light-emitting module further comprises:

a water-proof shell for sealing a light-emitting element, the controller and a power source.

7. The light-emitting decoration of claim 6, wherein the water-proof shell is formed by resin or plastic through an injection molding process.

8. A light-emitting decoration, comprising:

a main portion, comprising a second accommodating space and an open part; and an engagement portion, disposed on one surface of the main portion, the engagement portion comprising an extending portion so as to form a first accommodating space between the engagement portion and the surface of the main portion, the engagement portion having a gap connected with the first accommodating space;

wherein, while the light-emitting decoration is engaged with a subject object, the gap capably expends for allowing the subject object to enter the first accommodating space therethrough.

9. The light-emitting decoration of claim 8, further comprising a light-emitting module, the light-emitting module is placed into the second accommodating space via the open part.

10. The light-emitting decoration of claim 9, wherein the light-emitting module further comprises:

an actuator switch, sensing the movement of the light-emitting module for generating a control signal, and a controller electrically connected to the actuator switch for receiving the control signal and controlling a light-emitting diode to emit light according to the control signal.

11. The light-emitting decoration of claim 10, further comprising a water-proof shell formed by resin or plastic through an injection molding process.

12. A light-emitting decoration, comprising:

a main portion, having a base, a cylindrical wall connected to the base, and a second accommodating space formed between the base and the cylindrical wall;

an engagement portion, disposed on one surface of the main portion, the engagement portion comprising an extending portion so as to form a first accommodating space, the engagement portion having a gap connected with the first accommodating space, the engagement portion has a holding portion disposed at the end of the extending portion;

a light-emitting module, disposed in the second accommodating space;

an actuator switch, disposed in the second accommodating space, the actuator switch being capable of sensing the movement of the light-emitting module to generate a control signal; and a controller, disposed in the second accommodating space, the controller being electrically connected to the actuator switch, being capable of receiving the control signal and controlling a light-emitting diode to emit light according to the control signal;

wherein, while the light-emitting decoration is engaged with a subject object, the gap capably expends for allowing the subject object to enter the first accommodating space therethrough.

* * * * *